United States Patent [19]

Konig

[11] Patent Number: 5,063,390

[45] Date of Patent: Nov. 5, 1991

[54] NON-DISPERSIVE ACOUSTIC TRANSPORT TIME DELAY BEAM STEERING ANTENNA

[75] Inventor: Charles E. Konig, Staten Island, N.Y.

[73] Assignee: The United States of America as represented by the Secretary of the Army, Washington, D.C.

[21] Appl. No.: 656,915

[22] Filed: Feb. 19, 1991

[51] Int. Cl.[5] ..... H01Q 3/22
[52] U.S. Cl. ..... 342/375
[58] Field of Search ..... 342/375; 333/147, 148

[56] References Cited

U.S. PATENT DOCUMENTS

| | | | |
|---|---|---|---|
| 4,245,333 | 1/1981 | Jelks | 342/375 |
| 4,604,591 | 8/1986 | Vasile . | |
| 4,675,682 | 6/1987 | Adam et al. | 342/375 |
| 4,912,478 | 3/1990 | Daniel | 342/375 |

OTHER PUBLICATIONS

"Phased Array Antennas—An Overview/Knittel", Eli Brookner, Radar Technology, Oct. 1986, pp. 289-301.

*Primary Examiner*—Mark Hellner
*Attorney, Agent, or Firm*—Michael Zelenka; William H. Anderson

[57] ABSTRACT

A plurality of acoustic charge transport (ACT) tapped delay lines are coupled to respective antenna elements of a phased array antenna assembly to control the beam steering of either a transmitted or received electromagnetic wave in the megahertz (MHz) range. Each delay line, moreover, is comprised of an ACT channel region which operates as a delay line and further includes multiple signal output taps which can be selectively addressed from an address bus coupled to a digital controller for providing a predetermined delay. With each delay line being individually controlled, an improved technique for beam steering is provided.

5 Claims, 1 Drawing Sheet

NON-DISPERSIVE ACOUSTIC TRANSPORT TIME DELAY BEAM STEERING ANTENNA

GOVERNMENT INTEREST

The invention described herein may be manufactured, used, and licensed by or for the Government for governmental purposes without the payment to me of any royalty thereon.

FIELD OF THE INVENTION

This invention relates in general to RF beam forming apparatus and more particularly to non-dispersive beam steering apparatus for a phased array antenna operable at UHF frequencies.

BACKGROUND OF THE INVENTION

Electronically controlled phased array antennas are generally known and are comprised of three main parts, namely the radiating elements, the phase shifters, and feed network coupled to a source of RF energy in the case of a transmitter. For reception, the feed network is replaced by a receiver. In order to electronically control the antenna elements so that the beam can be steered electronically in space, it is normally necessary to use many closely spaced individual radiating elements with individual phase shifters controlling the elements in a piecewise fashion. The phase shifters themselves heretofore have taken many forms and designs. The subject of phased array antennas, moreover, are broadly covered in many publications. A typical example of such teachings is provided in Chapter 21, "Phased Array Antennas—An Overview/Knittel", pp. 290–301 of a text entitled *Radar Technology* by Eli Brookner, published by Artech House, Inc., October, 1986.

SUMMARY OF THE INVENTION

It is an object of the subject invention, therefore, to provide an improvement in RF antenna apparatus.

It is another object of the invention to provide an improvement in the control of phased array antennas.

And it is yet another object of the invention to provide an improvement in the beam steering control of phased array antennas.

Briefly, the foregoing and other objects are achieved by a plurality of acoustic charge transport (ACT) tapped delay lines coupled to respective antenna elements of a phased array antenna assembly to control the beam steering of either a transmitted or received electromagnetic wave in the megahertz (MHz) range. Each delay line, moreover, is comprised of an ACT channel region which operates as a delay line and further including multiple signal output taps which can be selectively addressed for providing a predetermined delay. With each delay line being individually controlled, an improved technique for beam steering is provided.

BRIEF DESCRIPTION OF THE DRAWINGS

These and other objects, features and details of the invention will become apparent in light of the ensuing detailed disclosure, and particularly in light of the drawings wherein.

DETAILED DESCRIPTION

Figure 1:
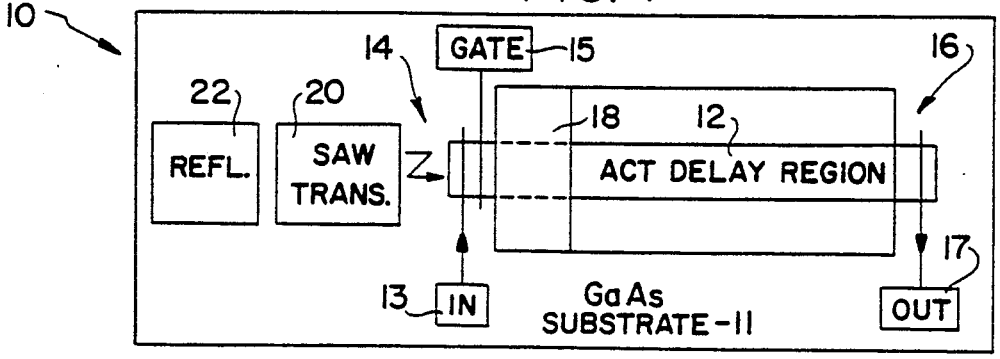
FIG. 1 (PRIOR ART)
FIG. 1 is an electrical block diagram illustrative of an acoustic charge transport delay line.

Referring now to the drawings and more particularly to FIG. 1, shown thereat is an acoustic charge transport (ACT) device configured as a delay line. An ACT device combines many of the performance and implementation features of charge couple devices (CCDs) and surface acoustic wave (SAW) devices fabricated in gallium arsenide (GaAs).

An ACT delay line comprises a high speed monolithic GaAs charge transfer device that is capable of providing RF signal delay. This function is achieved through the conversion of an analog input signal voltage to discrete charge packets that are translated through a semiconductor channel at a fixed velocity in accordance with a SAW launched on the channel and which are subsequently sensed at an output detection point. Charge packet transport is accomplished in a buried channel utilizing a piezoelectrically induced traveling wave electric field of a single frequency UHF surface acoustic wave that is generated directly in the GaAs. By analogy with the conventional charge coupled device, the propagating SAW function is a built-in clock signal that results in continuous charge transfer precisely at the characteristic SAW velocity, which is approximately 2864 m/sec. in a GaAs medium.

Shown in FIG. 1 is a typical proton isolated ACT delay line 10 formed on a GaAs substrate 11. An elongated ACT channel 12 is furthermore located on the substrate 10 and is bounded on either end by input and output regions 14 and 16 and including an input contact 13, a gate contact 15, and an output contact 17 coupled to the channel region 12. Adjacent the input region 14 there is formed an isolation region 18 fabricated by a proton isolation implant that renders the epitaxial layer outside the channel region 12 semi-insulating. Additionally, an SAW transducer element 20 and a SAW reflector 22 are positioned adjacent the input region 14.

In operation, the transducer 20 generates a relatively large, typically one volt, amplitude surface acoustic wave at an effective clock frequency determined by the characteristic periodicity cf the transducer. The delay line then consists of an input section including elements 13, 15 and 20 to the left of the isolation region 18, ACT delay element 12 to the right of the isolation section 18, and an output section including element 17 at the other end of the channel 12, all of which are illuminated by the SAW from the transducer 22.

Figure 2:
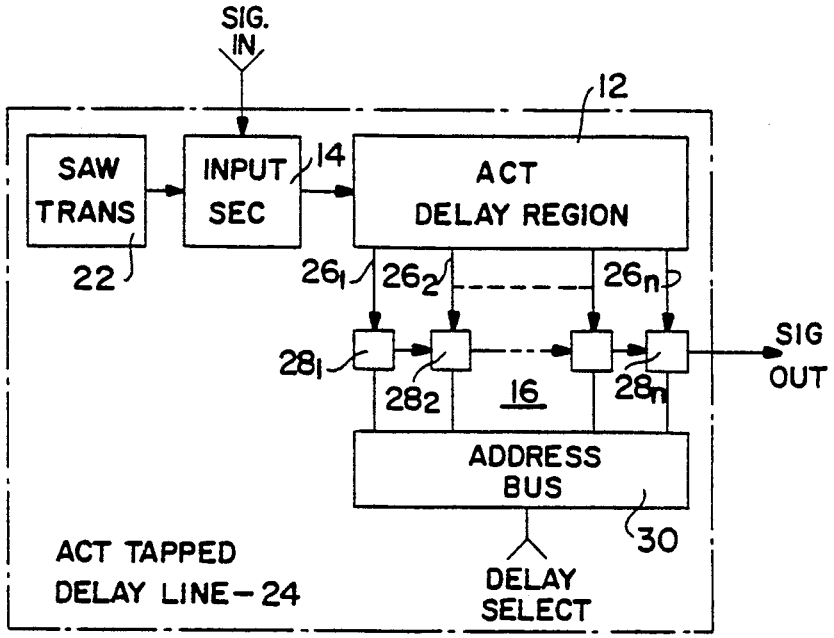
FIG. 2 is an electrical block diagram illustrative of an acoustic charge transport tapped delay line.

Referring now to FIG. 2, an ACT delay line as shown in FIG. 1 can be formed into a programmable delay line 24 which includes an ACT delay channel region 12. The output section 16, however, is now comprised of a plurality of non-dispersive signal taps $\mathbf{26_1}$–$\mathbf{26_n}$ to provide signals at the output of a serial chain of output gates $\mathbf{28_1}$–$\mathbf{28_n}$ which are digitally controlled by an address buss 30. Non-dispersive absolute delays of 40 nsec. to 2.6 μsec. or relative delays of 0 to 2.5 μsec can be provided when operated at 360 MHz, for example. Typically, an array of taps $\mathbf{26_1}$–$\mathbf{26_n}$ can include as many as 1024 taps spaced by 2.8 nsec. in time.

Figure 3:
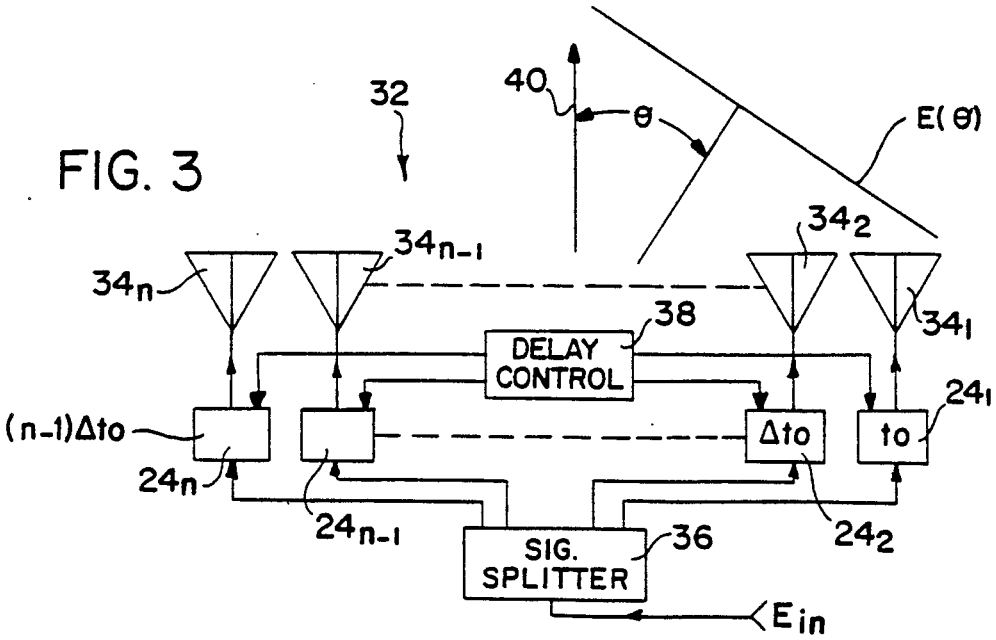
FIG. 3 is an electrical block diagram illustrative of the preferred embodiment of the invention.

A plurality of ACT tapped delay lines $\mathbf{24_1}$–$\mathbf{24_n}$ are utilized as shown in FIG. 3 to implement beam steering in a phased array antenna 32 comprised of a plurality of mutually spaced elements $\mathbf{34_1}$, $\mathbf{34_2}$ . . . $\mathbf{34_n}$ by coupling each of the tapped delay lines $\mathbf{24_1}$–$\mathbf{24_n}$ to a signal splitter 36 in the case of a transmitter or a signal combiner, not shown, in the case of a receiver. As illustrated, an RF input signal Ein is split and fed to each of the antenna elements $34_1$–$34_n$. The signal fed to each antenna element is delayed by a predetermined time $\Delta t_o$ by a digital controller 38 coupled to a respective address bus 39 (FIG. 2), whereupon a resultant wave E(Θ) is generated and radiated at an angle Θ from the center line 40 of the array.

An array 1024 elements 34 operating at a frequency of 360 MHz, for example, would yield a beamwidth ΘB of:

$$\Theta_B = 60\lambda/A = 60(0.833)/4.26.66 = 0.117^\circ \quad (1)$$

where λ is the wavelength and A is the aperture. Such an array would also yield a gain G of:

$$G = 10\ log\ (4\pi A/\lambda^2) = 10\ log\ (4\pi 512/0.833^2) = 39.67DB. \quad (2)$$

Where scanning is provided to an off broadside target, the instantaneous bandwidth is not limited by the array since beam scanning is not a function of frequency change. The following equation is descriptive of time delay beam steering achieved by such an array:

$$E(\Theta) = E_e(\Theta)\Sigma A_n \exp\ [j(2\pi/\lambda)\ n\Delta \times (\sin\Theta - \sin\Theta)] \quad (3)$$

where E(Θ) is the antenna field pattern, $E_e$ is the RF input, Θ is the direction angle off of the array center line, and n is the number of antenna elements.

Thus what has been shown and described is a non-dispersive time delay beam former implemented by way of digitally controlled acoustic charge transport delay lines which can be digitally controlled to effect beam steering.

Having thus shown and described what is at present considered to be the preferred embodiment of the invention, it should be noted that the same has been made by way of illustration and not limitation. Accordingly, all alterations, changes and modifications coming within the spirit and scope of the invention are herein meant to be included.

What is claimed is:

1. Beam steering apparatus for phased array antenna assembly including a plurality of antenna elements, comprising;

variable charge transport delay line means coupled to each of said antenna elements, wherein each said charge transport delay line means comprises an acoustic transport device; and phase control means coupled to each said delay line means, wherein said phase control means controlls the phase shift imparted to respective RF energy coupled to and translated by said delay lines means, whereby time delay beam steering of an RF wave is effected at said antenna.

2. The beam steering apparatus as defined by claim 1 wherein each acoustic charge transport device comprises an acoustic charge transport delay line having a plurality of signal outputs successively delayed in time to provide a selected time delay of an RF input signal coupled to the delay line.

3. The beam steering apparatus as defined by claim 1 wherein each acoustic charge transport device comprises a delay line comprised of:

a charge transport channel operable as a time delay region and having a plurality of output taps;

means for launching a surface acoustic wave on said channel to effect charge transport of an RF input signal coupled to the channel;

input means for coupling an RF signal to said channel; and means for selectively coupling a time delayed RF output signal from said channel at one of said output taps.

4. The beam steering apparatus as defined by claim 3 wherein said means for selectively coupling includes, a signal gate coupled to each of said output taps; and means for enabling a selected number of said gates coupled to said phase control means.

5. The beam steering apparatus as defined by claim 4 wherein said means for enabling comprises a digital address bus coupled to and controlled by said phase control means.

* * * * *